US011641065B2

(12) United States Patent
So et al.

(10) Patent No.: US 11,641,065 B2
(45) Date of Patent: May 2, 2023

(54) ANTENNA DEVICE

(71) Applicants: SAMSUNG ELECTRO-MECHANICS CO., LTD., Suwon-si (KR); Research & Business Foundation SUNGKYUNKWAN UNIVERSITY, Suwon-si (KR)

(72) Inventors: Won Wook So, Suwon-si (KR); Jeongki Ryoo, Suwon-si (KR); Woncheol Lee, Suwon-si (KR); Youngsik Hur, Suwon-si (KR); Keum Cheol Hwang, Suwon-si (KR); Nam Heung Kim, Suwon-si (KR); Yong-Serk Kim, Suwon-si (KR)

(73) Assignees: Samsung Electro-Mechanics Co., Ltd., Suwon-si (KR); Research & Business Foundation SUNGKYUNKWAN UNIVERSITY, Suwon-si (KR)

( * ) Notice: Subject to any disclaimer, the term of this patent is extended or adjusted under 35 U.S.C. 154(b) by 17 days.

(21) Appl. No.: 17/361,789

(22) Filed: Jun. 29, 2021

(65) Prior Publication Data

US 2022/0166149 A1 May 26, 2022

(30) Foreign Application Priority Data

Nov. 23, 2020 (KR) ..... 10-2020-0158133

(51) Int. Cl.
*H01Q 21/06* (2006.01)
*H01Q 5/307* (2015.01)
*H01Q 9/04* (2006.01)

(52) U.S. Cl.
CPC ..... *H01Q 21/065* (2013.01); *H01Q 5/307* (2015.01); *H01Q 9/0414* (2013.01)

(58) Field of Classification Search
CPC ..... H01Q 21/065; H01Q 5/307; H01Q 9/0414
See application file for complete search history.

(56) References Cited

U.S. PATENT DOCUMENTS

2011/0001682 A1 1/2011 Rao
2019/0020110 A1 1/2019 Paulotto et al.
(Continued)

FOREIGN PATENT DOCUMENTS

KR 10-2019-0123195 A 10/2019

OTHER PUBLICATIONS

M. Stanley, et al. "A Dual-Band Dual-Polarised Stacked Patch Antenna for 28 GHz and 39 GHz 5G Millimetre-Wave Communication," 2019 13th European Conference on Antennas and Propagation (EuCAP), pp. 1-4, 2019 (4 pages in English).
(Continued)

*Primary Examiner* — Dieu Hien T Duong
(74) *Attorney, Agent, or Firm* — NSIP Law

(57) ABSTRACT

An antenna device is provided. The antenna device includes a first antenna patch configured to transmit and receive an RF signal in a first frequency bandwidth and disposed a first dielectric layer; a second antenna patch disposed on a second dielectric layer and coupled to the first antenna patch; a third antenna patch disposed on a third dielectric layer and coupled to the second antenna patch; and a fourth antenna patch configured to transmit and receive an RF signal in the second frequency bandwidth, wherein the second antenna patch includes a plurality of first sub-antenna patches that do not overlap the first antenna patch, and the third antenna patch includes a plurality of second sub-antenna patches that overlap the first sub-antenna patches.

20 Claims, 23 Drawing Sheets

(56) References Cited

U.S. PATENT DOCUMENTS

| | | | | |
|---|---|---|---|---|
| 2019/0326672 | A1 | 10/2019 | Lim et al. | |
| 2021/0367358 | A1* | 11/2021 | He | H01Q 25/00 |
| 2022/0255229 | A1* | 8/2022 | Jia | H01Q 21/065 |
| 2022/0255238 | A1* | 8/2022 | Yu | H01Q 5/28 |

OTHER PUBLICATIONS

M. M. M. Ali and A-R Sebak, "Dual Band(28/38 GHz) CPW Slot Directive Antenna for Future 5G Cellular Applications," IEEE International Symposium on Antennas and Propagation, pp. 399-400, 2016 (2 pages in English).

* cited by examiner

ANTENNA DEVICE

CROSS-REFERENCE TO RELATED APPLICATIONS

This application claims the benefit under 35 USC § 119(a) to Korean Patent Application No. 10-2020-0158133 filed in the Korean Intellectual Property Office on Nov. 23, 2020, the entire disclosure of which is incorporated herein by reference for all purposes.

BACKGROUND

1. Field

The following description relates to an antenna device.

2. Description of Related Art

Recently, mmWave communication, including $5^{th}$ generation (5G) communication, has been actively implemented, and technologies that commercialize and standardize radio frequency modules for implementing 5G communication have been utilized. In the example of $5^{th}$ generation (5G) communication, the demands or capacity on multi-bandwidth antennas for transmitting and receiving RF signals with various bandwidths with one antenna are increasing.

Further, as portable electronic devices have been developed, the size of the screen that is a display area of the electronic device has become larger, and the size of a bezel that is a non-display area in which an antenna is disposed has been reduced, and the area of the region in which the antenna may be installed has also been reduced.

The above information disclosed in this Background section is only for enhancement of understanding of the background of the described technology, and therefore it may contain information that does not form the prior art that is already known in this country to a person of ordinary skill in the art.

SUMMARY

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

In a general aspect, an antenna device includes a first antenna patch, configured to transmit and receive a radio frequency (RF) signal in a first frequency bandwidth, and disposed on a first dielectric layer of a plurality of dielectric layers; a second antenna patch, disposed on a second dielectric layer of the plurality of dielectric layers, and coupled to the first antenna patch; a third antenna patch, disposed on a third dielectric layer of the plurality of dielectric layers, and coupled to the second antenna patch; and a fourth antenna patch, configured to transmit and receive an RF signal in a second frequency bandwidth, wherein the second antenna patch comprises a plurality of first sub-antenna patches that do not overlap the first antenna patch, and the third antenna patch comprises a plurality of second sub-antenna patches that overlap the first sub-antenna patches.

The second antenna patch may further include a center antenna patch, and the first sub-antenna patches are separated from the center antenna patch, and are disposed to surround the center antenna patch in a first direction and a second direction, and wherein the center antenna patch overlaps the first antenna patch in a third direction that is perpendicular to the first direction and the second direction.

The fourth antenna patch may not overlap the third antenna patch in the third direction.

A first feed via and a second feed via may be configured to penetrate at least one of the plurality of dielectric layers, wherein the first antenna patch may be configured to receive electrical signals from the first feed via and the second feed via.

The antenna device may further include a third feed via and a fourth feed via configured to penetrate at least one of the plurality of dielectric layers, wherein the fourth antenna patch is configured to receive electrical signals from the third feed via and the fourth feed via.

The fourth antenna patch may further include a first expansion that extends from an edge disposed near the third feed via, and a second expansion that extends from an edge disposed near the fourth feed via.

The fourth antenna patch may further include a first opening disposed near the third feed via, and a second opening disposed near the fourth feed via.

The first sub-antenna patches may include a first sub-patch disposed near the first feed via, a second sub-patch disposed near the second feed via, a third sub-patch disposed near the third feed via, and a fourth sub-patch disposed near the fourth feed via, and wherein a first space between the center antenna patch and the first sub-patch is less than a second space between the center antenna patch and the third sub-patch.

The antenna may further include a ground plane, disposed below the plurality of dielectric layers in the third direction, wherein the ground plane has a first width in the first direction and a second width in the second direction, and wherein the first width may be greater than the second width.

The antenna device may further include a plurality of vias connected to the ground plane and configured to penetrate at least one of the plurality of dielectric layers, and wherein the vias do not overlap the first antenna patch and the second antenna patch in the third direction.

The first antenna patch may have a third width in the first direction and a fourth width in the second direction, and wherein the fourth width may be greater than the third width.

The center antenna patch may have a fifth width in the first direction and a sixth width in the second direction, and wherein the fifth width may be equal to the third width, and the sixth width is equal to the fourth width.

The fourth antenna patch may have a seventh width in the first direction and an eighth width in the second direction, and wherein the seventh width may be less than the fifth width, and the eighth width is less than the sixth width.

The antenna device may include a fifth antenna patch overlapping the fourth antenna patch in the third direction.

The fifth antenna patch may have a ninth width in the first direction and a tenth width in the second direction, and the ninth width may be equal to the seventh width, and the tenth width is equal to the eighth width.

In a general aspect, an antenna device includes a plurality of antennae disposed in parallel with each other in a first direction, wherein the plurality of antennae include a first antenna patch, disposed on a first dielectric layer among a plurality of dielectric layers stacked in a third direction that is perpendicular to the first direction, and configured to transmit and receive a radio frequency (RF) signal in a first frequency bandwidth, a second antenna patch, disposed on a second dielectric layer among the plurality of dielectric layers, and coupled to the first antenna patch, a third antenna patch, disposed on a third dielectric layer among the plurality of dielectric layers, and coupled to the second antenna patch, a fourth antenna patch, disposed on a fourth dielectric layer among the plurality of dielectric layers, and configured to transmit and receive an RF signal in a second frequency bandwidth, and a first feed via and a second feed via configured to penetrate at least one of the plurality of dielectric layers, and configured to apply an electrical signal to the first antenna patch, wherein the plurality of antennae include a first antenna and a second antenna, and respective positions of the second feed via, a third feed via, and a fourth feed via with respect to the first feed via of the first antenna are different from respective positions of the second feed via, the third feed via, and the fourth feed via with respect to the first feed via of the second antenna.

The second antenna patch may include a center antenna patch that overlaps the first antenna patch in the third direction, and a plurality of first sub-antenna patches separated from the center antenna patch and configured to surround the center antenna patch.

The third antenna patch may include a plurality of second sub-antenna patches overlapping the first sub-antenna patches in the third direction.

The fourth antenna patch may not overlap the third antenna patch in the third direction.

The plurality of antennae may further include a third antenna and a fourth antenna, wherein relative positions of the second feed via and the fourth feed via of the second antenna are equal to rotating positions by 180 degrees from the positions of the second feed via and the fourth feed via of the first antenna, wherein relative positions of the first feed via and the third feed via of the third antenna are equal to rotating positions by 180 degrees from the positions of the first feed via and the third feed via of the first antenna, and wherein relative positions of the first feed via, the second feed via, the third feed via, and the fourth feed via of the fourth antenna are equal to rotating positions by 180 degrees from the positions of the first feed via, the second feed via, the third feed via, and the fourth feed via of the first antenna.

Other features and aspects will be apparent from the following detailed description, the drawings, and the claims.

Figure 1:
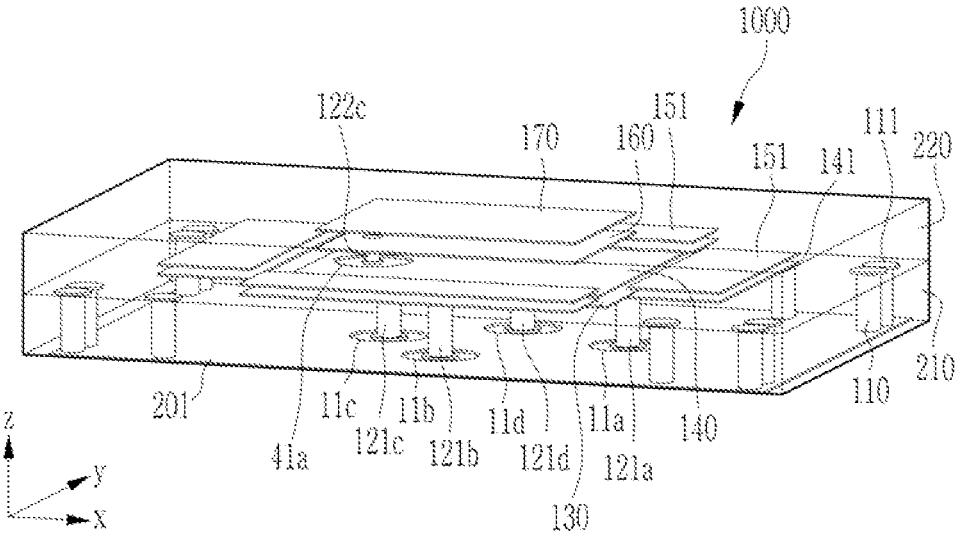
FIG. 1 illustrates a perspective view of an antenna device, in accordance with one or more embodiments.

Throughout the drawings and the detailed description, unless otherwise described or provided, the same drawing reference numerals will be understood to refer to the same elements, features, and structures. The drawings may not be to scale, and the relative size, proportions, and depiction of elements in the drawings may be exaggerated for clarity, illustration, and convenience.

DETAILED DESCRIPTION

The following detailed description is provided to assist the reader in gaining a comprehensive understanding of the methods, apparatuses, and/or systems described herein. However, various changes, modifications, and equivalents of the methods, apparatuses, and/or systems described herein will be apparent after an understanding of the disclosure of this application. For example, the sequences of operations described herein are merely examples, and are not limited to those set forth herein, but may be changed as will be apparent after an understanding of the disclosure of this application, with the exception of operations necessarily occurring in a certain order. Also, descriptions of features that are known after an understanding of the disclosure of this application may be omitted for increased clarity and conciseness, noting that omissions of features and their descriptions are also not intended to be admissions of their general knowledge The features described herein may be embodied in different forms, and are not to be construed as being limited to the examples described herein. Rather, the examples described herein have been provided merely to illustrate some of the many possible ways of implementing the methods, apparatuses, and/or systems described herein that will be apparent after an understanding of the disclosure of this application.

The size and thickness of each configuration shown in the drawings are arbitrarily shown for better understanding and ease of description, but the examples are not limited thereto. In the drawings, the thickness of layers, films, panels, regions, etc., are exaggerated for clarity. The thicknesses of some layers and areas are exaggerated for convenience of explanation.

It will be understood that when an element such as a layer, film, region, or substrate is referred to as being "on" another element, it can be directly on the other element or intervening elements may also be present. In contrast, when an element is referred to as being "directly on" another element, there are no intervening elements present. The word "on" or "above" means disposed on or below the object portion, and does not necessarily mean disposed on the upper side of the object portion based on a gravitational direction.

Although terms such as "first," "second," and "third" may be used herein to describe various members, components, regions, layers, or sections, these members, components, regions, layers, or sections are not to be limited by these terms. Rather, these terms are only used to distinguish one member, component, region, layer, or section from another member, component, region, layer, or section. Thus, a first member, component, region, layer, or section referred to in examples described herein may also be referred to as a second member, component, region, layer, or section without departing from the teachings of the examples.

The phrase "in a plan view" means viewing an object portion from the top, and the phrase "in a cross-sectional view" means viewing a cross-section of which the object portion is vertically cut from the side.

Throughout the specification, when an element, such as a layer, region, or substrate is described as being "on," "connected to," or "coupled to" another element, it may be directly "on," "connected to," or "coupled to" the other element, or there may be one or more other elements intervening therebetween. In contrast, when an element is described as being "directly on," "directly connected to," or "directly coupled to" another element, there can be no other elements intervening therebetween.

The terminology used herein is for describing various examples only, and is not to be used to limit the disclosure. The articles "a," "an," and "the" are intended to include the plural forms as well, unless the context clearly indicates otherwise. The terms "comprises," "includes," and "has" specify the presence of stated features, numbers, operations, members, elements, and/or combinations thereof, but do not preclude the presence or addition of one or more other features, numbers, operations, members, elements, and/or combinations thereof.

Unless otherwise defined, all terms, including technical and scientific terms, used herein have the same meaning as commonly understood by one of ordinary skill in the art to which this disclosure pertains and after an understanding of the disclosure of this application. Terms, such as those defined in commonly used dictionaries, are to be interpreted as having a meaning that is consistent with their meaning in the context of the relevant art and the disclosure of this application, and are not to be interpreted in an idealized or overly formal sense unless expressly so defined herein.

Throughout the specification, when it is described that a part is "coupled" to another part, the part may be "directly or physically connected" to the other part or "indirectly or non-contact coupled" to the other part with a third part therebetween.

Figure 2:
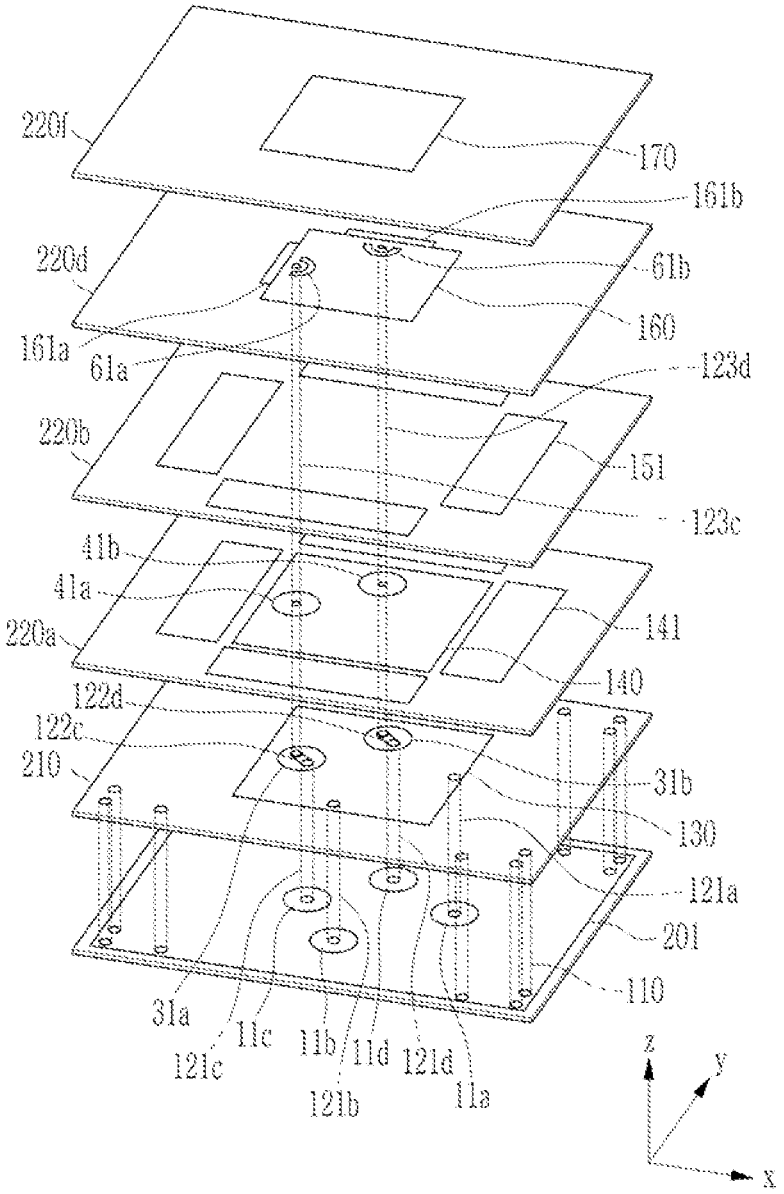
FIG. 2 illustrates an exploded perspective view of an antenna device of FIG. 1.
Figure 3:
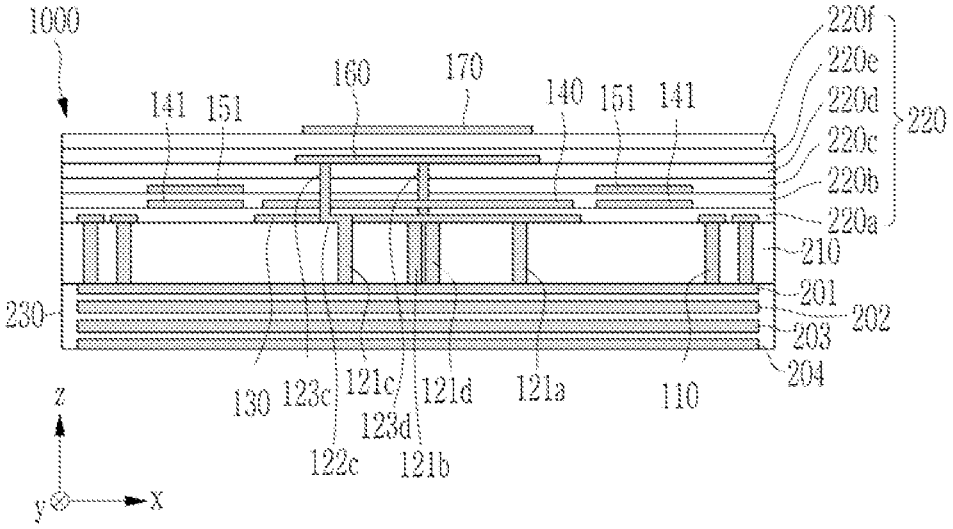
FIG. 3 illustrates a cross-sectional view of an antenna device of FIG. 1.
Figure 4:
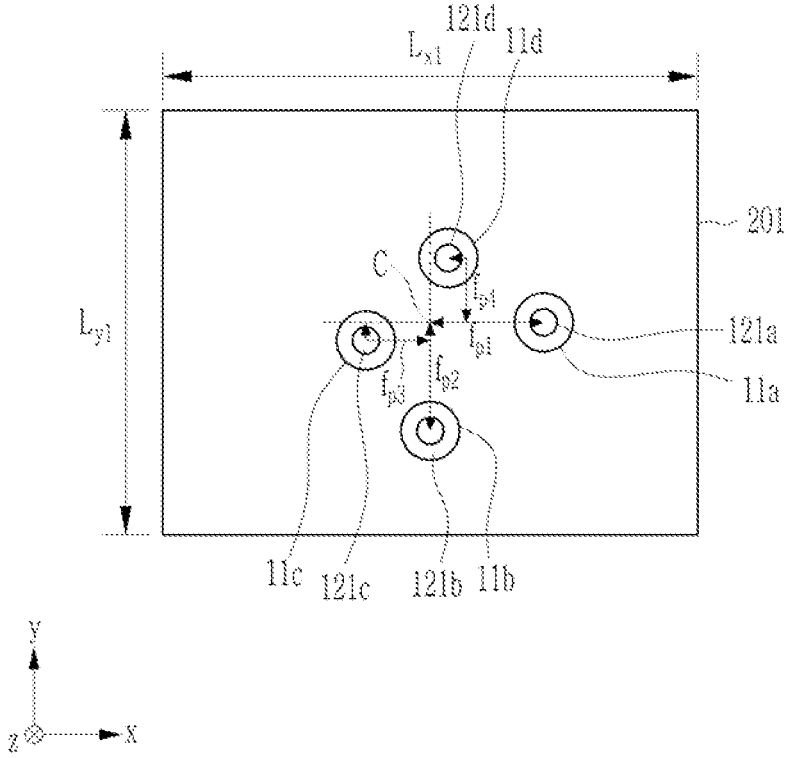
FIG. 4 illustrates a top plan view of part of an antenna device of FIG. 1.
Figure 5:
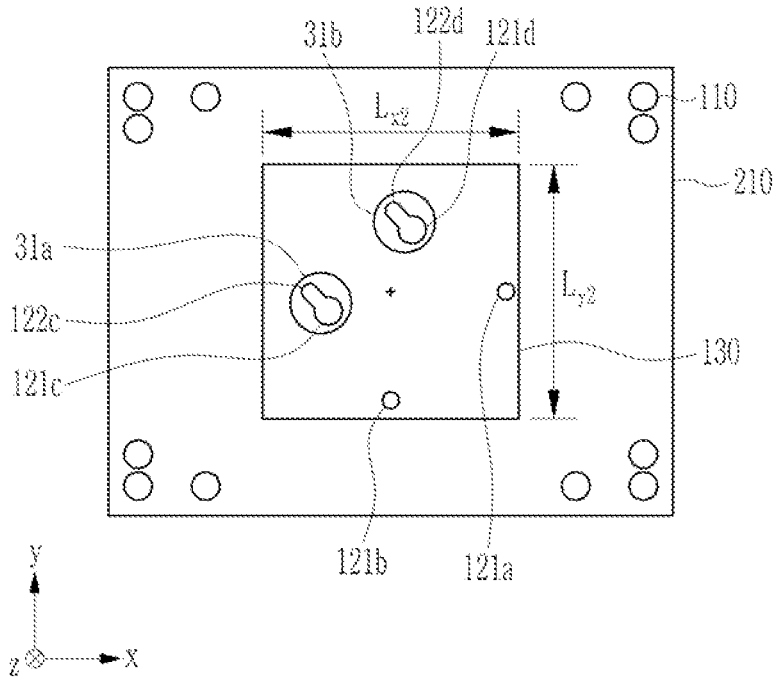
FIG. 5 illustrates a top plan view of part of an antenna device of FIG. 1.
Figure 6:
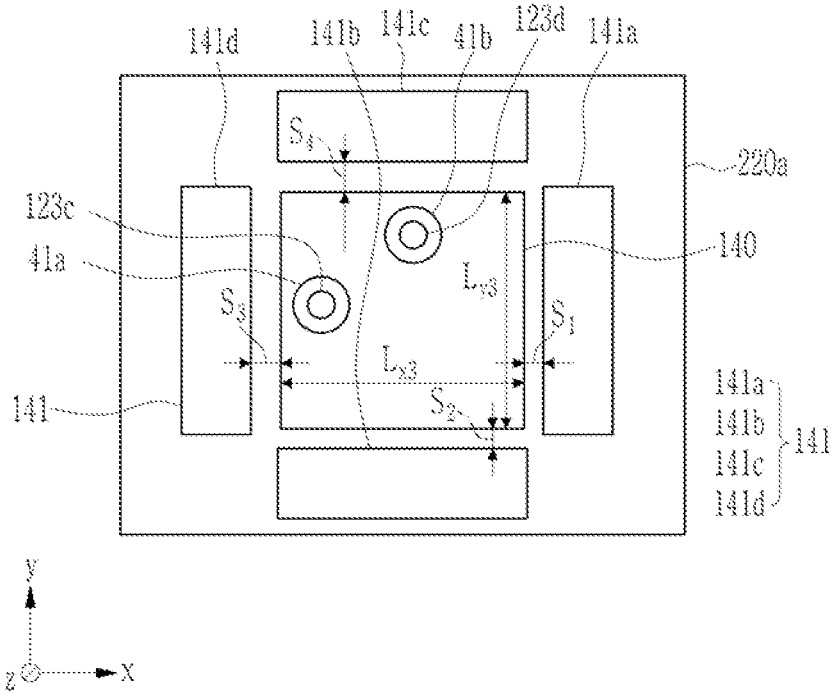
FIG. 6 illustrates a top plan view of part of an antenna device of FIG. 1.
Figure 7:
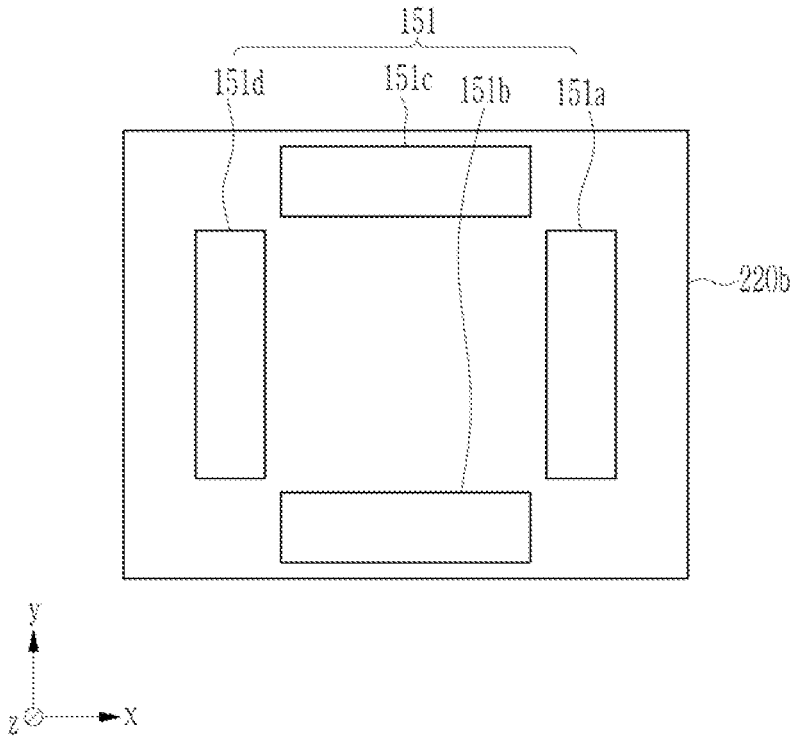
FIG. 7 illustrates a top plan view of part of an antenna device of FIG. 1.
Figure 8:
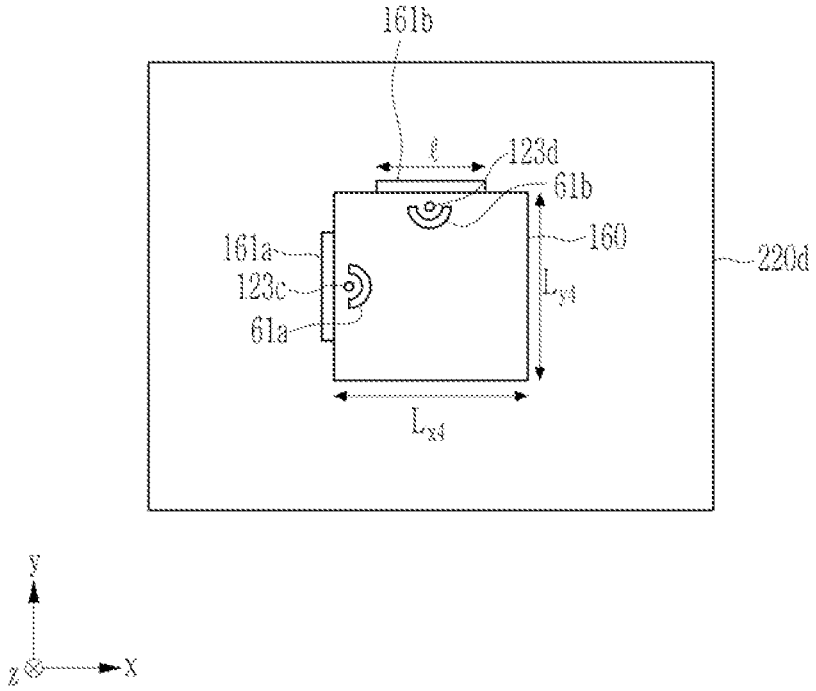
FIG. 8 illustrates a top plan view of part of an antenna device of FIG. 1.
Figure 9:
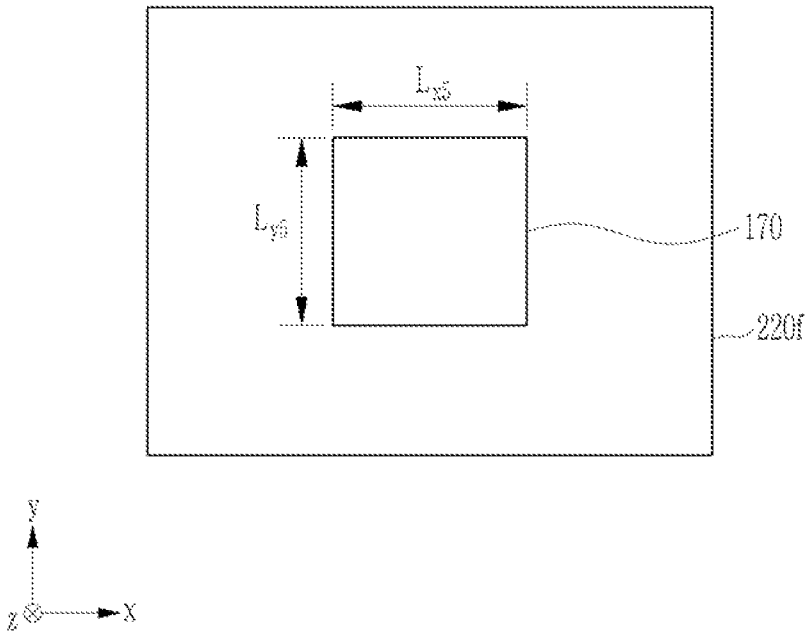
FIG. 9 illustrates a top plan view of part of an antenna device of FIG. 1.

An antenna device 1000, in accordance with one or more embodiments, will now be described with reference to FIG. 1 to FIG. 9. FIG. 1 illustrates a perspective view of an antenna device, in accordance with one or more embodiments, FIG. 2 illustrates an exploded perspective view of an antenna device of FIG. 1, and FIG. 3 illustrates a cross-sectional view of an antenna device of FIG. 1. FIG. 4 to FIG. 9 show top plan views of part of an antenna device of FIG. 1.

Referring to FIG. 1 to FIG. 3, the antenna device 1000 includes a first feed via 121*a*, a second feed via 121*b*, a third feed via 121*c*, a fourth feed via 121*d*, a first antenna patch 130, second antenna patches 140 and 141, a third antenna patch 151, a fourth antenna patch 160, a fifth antenna patch 170, and a plurality of vias 110.

The antenna device 1000 further includes a first dielectric layer 210 that extends in a third direction z that is orthogonal to a plane generated when a first direction x traverses a second direction y, in the first direction x and the second direction y, a second dielectric layer 220 (220*a*, 220*b*, 220*c*, 220*d*, 220*e*, and 220*f*) disposed on the first dielectric layer 210 in the third direction z, and a ground plane 201 disposed below the first dielectric layer 210 in the third direction z.

The second dielectric layer 220 may include a plurality of layers 220*a*, 220*b*, 220*c*, 220*d*, 220*e*, and 220*f*, and for example, it may include a first layer 220*a*, a second layer 220*b*, a third layer 220*c*, a fourth layer 220*d*, a fifth layer 220*e*, and a sixth layer 220*f* sequentially disposed on the first dielectric layer 210 in the third direction z.

In an example, the first dielectric layer 210 may have a dielectric constant of 3.55, a loss tangent of 0.004, and a thickness of 400 μm, but it is not limited thereto. The second dielectric layer 220 may include a plurality of layers made of a prepreg dielectric material with the dielectric constant of 3.55 and the loss tangent of 0.004.

The first antenna patch 130, the second antenna patches 140 and 141, the third antenna patch 151, the fourth antenna patch 160, and the fifth antenna patch 170 may be disposed among a plurality of layers 220*a*, 220*b*, 220*c*, 220*d*, 220*e*, and 220*f* configuring the second dielectric layer 220.

The second antenna patches 140 and 141 include a center antenna patch 140 and a sub-antenna patch 141 disposed on the same layer, the sub-antenna patch 141, of the second antenna patches 140 and 141, may be disposed on a lateral side of the center antenna patch 140 of the second antenna patches 140 and 141 to be disposed to surround the center antenna patch 140 in the first direction x and the second direction y.

The first antenna patch 130 may overlap the center antenna patch 140 of the second antenna patches 140 and 141 in the third direction z, and the third antenna patch 151 may overlap the sub-antenna patch 141 of the second antenna patches 140 and 141 in the third direction z.

The first antenna patch 130 may be a driven patch that transmits and receives a signal in a first frequency bandwidth, the center antenna patch 140 of the second antenna patches 140 and 141 may be a director that transmit and receive a signal in the first frequency bandwidth, and the sub-antenna patch 141 and the third antenna patch 151 of the second antenna patches 140 and 141 may be parasitic patches that transmit and receive a signal in the first frequency bandwidth. However, they are not limited thereto.

The fourth antenna patch 160 may overlap the fifth antenna patch 170 in the third direction z. The fourth antenna patch 160 and the fifth antenna patch 170 may not overlap the third antenna patch 151 in the third direction z.

The fourth antenna patch 160 may be a driven patch that transmits and receives a signal in the second frequency bandwidth, and the fifth antenna patch 170 may be a director that transmits and receives a signal in the second frequency bandwidth. However, they are not limited thereto.

A plurality of vias 110 is connected to the ground plane 201.

A plurality of vias 110 may be disposed near four apices of the ground plane 201 on one plane configured when the first direction x traverses the second direction y. Specifically, a plurality of vias 110 may be disposed near corners formed when two sides of the ground plane 201 in parallel to the first direction x traverse two sides in parallel to the direction y.

A plurality of vias 110 may not overlap antenna patches 130, 140, 141, 151, 160, and 170 in the third direction z.

A plurality of vias 110 may penetrate through the first dielectric layer 210, and may include expansions 111 connected to a plurality of vias 110 and disposed on the first dielectric layer 210.

Referring to FIG. 1 to FIG. 3 and FIG. 4, the ground plane 201 has a quadrangular and planar shape. The ground plane 201 may have a first width Lx1 in the first direction x and a second width Ly1 in the second direction y, and the first width Lx1 may be greater than the second width Ly1.

A first distance fp1 to a center of a first feed via 121*a* from a center C of the ground plane 201 in the first direction x may be substantially equal to a second distance fp2 to a center of a second feed via 121*b* from the center C of the ground plane 201 in the second direction y. However, the first distance fp1 may be greater than the second distance fp2.

A third distance fp3 to a center of the third feed via 121*c* from the center C of the ground plane 201 in the first direction x may be substantially equal to a fourth distance fp4 to a center of the fourth feed via 121*d* from the center C of the ground plane 201 in the second direction y. However, in an example, the third distance fp3 may be greater than the fourth distance fp4.

The first distance fp1 and the second distance fp2 may be greater than the third distance fp3 and the fourth distance fp4.

The first feed via 121*a* and the second feed via 121*b* may penetrate into the first dielectric layer 210 and at least part of the second dielectric layer 220. Further, the first feed via 121*a* and the second feed via 121*b* may not be connected to the ground plane 201 but may penetrate the ground plane 201 through a first hole 11*a* and a second hole 11*b* formed in the ground plane 201.

Similarly, the third feed via 121*c* and the fourth feed via 121*d* may penetrate the first dielectric layer 210 and at least part of the second dielectric layer 220. Further, the third feed via 121*c* and the fourth feed via 121*d* may not be connected to the ground plane 201 but may penetrate the ground plane 201 through a third hole 11*c* and a fourth hole 11*d* disposed in the ground plane 201.

Referring to FIG. 1 to FIG. 3 and FIG. 5, the first antenna patch 130 is disposed on the first dielectric layer 210.

The first antenna patch 130 may have a quadrangular and planar shape. The first antenna patch 130 may have a third width Lx2 in the first direction x, and may have a fourth width Ly2 in the second direction y. The third width Lx2 may be substantially equivalent to the fourth width Ly2, and the fourth width Ly2 may be greater than the third width Lx2.

The first feed via 121*a* and the second feed via 121*b* penetrate the first dielectric layer 210 and are connected to the first antenna patch 130. The first antenna patch 130 may be connected to the first feed via 121*a* and the second feed via 121*b*, and may receive electrical signals from the first feed via 121*a* and the second feed via 121*b*. However, it is not limited thereto, and the first feed via 121*a* and the second feed via 121*b* may not be connected to the first antenna patch 130, but may be separated from the first antenna patch 130 and may transmit an electrical signal by coupling.

The third feed via 121*c* and the fourth feed via 121*d* may penetrate the first dielectric layer 210, and may be connected to the first feed pattern 122*c* and the second feed pattern 122*d* disposed on the first dielectric layer 210.

The first antenna patch 130 may have a fifth hole 31*a* and a sixth hole 31*b*, and the first feed pattern 122*c* and the second feed pattern 122*d* may be respectively disposed in the fifth hole 31*a* and the sixth hole 31*b* of the first antenna patch 130, so the first feed pattern 122*c* and the second feed pattern 122*d* may not be connected to the first antenna patch 130, but may penetrate the first antenna patch 130.

The first feed pattern 122*c* and the second feed pattern 122*d* are connected to the third feed pattern 123*c* and the fourth feed pattern 123*d* which extend from the first feed pattern 122*c* and the second feed pattern 122*d* in the third direction z and penetrate the first layer 220*a*, the second layer 220*b*, the third layer 220*c*, and the fourth layer 220*d* of the second dielectric layer 220.

Referring to FIG. 1 to FIG. 3 and FIG. 6, the second antenna patches 140 and 141 are disposed on a first layer 220*a* of the second dielectric layer 220.

The center antenna patch 140 of the second antenna patches 140 and 141 may have a quadrangular and planar shape.

The center antenna patch 140 of the second antenna patches 140 and 141 may have a fifth width Lx3 in the first direction x, and may have a sixth width Ly3 in the second direction y. The fifth width Lx3 may be substantially equivalent to the sixth width Ly3, and however the sixth width Ly3 may be greater than the fifth width Lx3. The fifth width Lx3 and the sixth width Ly3 may be equivalent to the third width Lx2 and the fourth width Ly2.

The center antenna patch 140 of the second antenna patches 140 and 141 has a seventh hole 41*a* and an eighth hole 41*b*.

The third feed pattern 123*c* and the fourth feed pattern 123*d* connected to the third feed via 121*c* and the fourth feed via 121*d* through the first feed pattern 122*c* and the second feed pattern 122*d* are disposed in the seventh hole 41*a* and the eighth hole 41*b* of the center antenna patch 140, and the first feed pattern 122*c* and the second feed pattern 122*d* are not connected to the center antenna patch 140 of the second antenna patches 140 and 141 but penetrate the same.

The sub-antenna patch 141 of the second antenna patches 140 and 141, may be disposed around the center antenna patch 140 and may be disposed to surround the center antenna patch 140, and the sub-antenna patch 141 may be disposed to be separated from the center antenna patch 140. In an example, the sub-antenna patch 141 may be implemented in a plurality of numbers, and respective sub-antenna patches may be implemented at respective sides of the center antenna patch 140.

The sub-antenna patch 141 may include a first sub-patch 141*a* disposed near the first feed via 121*a* in the first direction x, a second sub-patch 141*b* disposed near the second feed via 121*b* in the second direction y, a third sub-patch 141*c* disposed near the third feed via 121*c* in the first direction x, and a fourth sub-patch 141*d* disposed near the fourth feed via 121*d* in the second direction y.

In an example, the first sub-patch 141*a*, the second sub-patch 141*b*, the third sub-patch 141*c*, and the fourth sub-patch 141*d* of the sub-antenna patch 141 may have a rectangular and planar shape, and respective lengths and widths may be the same or different.

Spaces s3 and s4 between the third sub-patch 141*c* and the fourth sub-patch 141*d* of the sub-antenna patch 141 and the center antenna patch 140 may be greater than spaces s1 and s2 between the first sub-patch 141*a* and the second sub-patch 141*b* of the sub-antenna patch 141 and the center antenna patch 140.

The sub-antenna patch 141 may additionally be coupled with the center antenna patch 140, which is connected to the first feed via 121*a* and the second feed via 121*b*. In this instance, an influence between the electric signal applied to the third feed via 121*c* and the fourth feed via 121*d* and the sub-antenna patch 141 may be reduced by relatively increasing the spaces s3 and s4 between the third sub-patch 141*c* and the fourth sub-patch 141*d* disposed near the third feed via 121*c* and the fourth feed via 121*d* from among the sub-patches 141*a*, 141*b*, 141*c*, and 141*d* of the sub-antenna patch 141 and the center antenna patch 140.

Referring to FIG. 1 to FIG. 3 and FIG. 7, the third antenna patch 151 is disposed on the second layer 220*b* of the second dielectric layer 220.

In a like manner of the sub-antenna patch 141 of the second antenna patches 140 and 141, the third antenna patch 151 may include a fifth sub-patch 151*a* disposed near the first feed via 121*a* in the first direction x, a sixth sub-patch 151*b* disposed near the second feed via 121*b* in the second direction y, a seventh sub-patch 151*c* disposed near the third feed via 121*c* in the first direction x, and an eighth sub-patch 151*d* disposed near the fourth feed via 121*d* in the second direction y.

The fifth sub-patch 151*a*, the sixth sub-patch 151*b*, the seventh sub-patch 151*c*, and the eighth sub-patch 151*d* of the third antenna patch 151 may have rectangular and planar shapes, and respective lengths and width may be the same or may be different.

The fifth sub-patch 151*a* of the third antenna patch 151 may overlap the first sub-patch 141*a* of the sub-antenna patch 141 in the third direction z, and the sixth sub-patch 151*b* of the third antenna patch 151 overlaps the second sub-patch 141*b* of the sub-antenna patch 141 in the third direction z. Similarly, the seventh sub-patch 151*c* of the third antenna patch 151 may overlap the third sub-patch 141*c* of the sub-antenna patch 141 in the third direction z, and the eighth sub-patch 151*d* of the third antenna patch 151 may overlap the fourth sub-patch 141*d* of the sub-antenna patch 141 in the third direction z.

The third antenna patch 151 configures an additional coupling with the second antenna patches 140 and 141. Accordingly, a gain of the antenna device 1000 may be increased.

Referring to FIG. 1 to FIG. 3 and FIG. 8, the fourth antenna patch 160 is disposed on the fourth layer 220*d* of the second dielectric layer 220.

The fourth antenna patch 160 may have a quadrangular and planar shape.

The fourth antenna patch 160 may have a seventh width Lx4 in the first direction x, and may have an eighth width Ly4 in the second direction y. In an example seventh width Lx4 may be substantially the same as the eighth width Ly4. However, this is only an example, and the seventh width Lx4 may be different from the eighth width Ly4.

In an example, the seventh width Lx4 and the eighth width Ly4 may be less than the fifth width Lx3 and the sixth width Ly3.

The third feed pattern 123*c* and the fourth feed pattern 123*d* penetrate the first layer 220*a* to the fourth layer 220*d* of the second dielectric layer 220, and may be connected to the fourth antenna patch 160 disposed on the fourth layer 220*d* of the second dielectric layer 220. The fourth antenna patch 160 may be connected to the third feed pattern 123*c* and the fourth feed pattern 123*d*, and may receive electric signals from the third feed via 121*c* and the fourth feed via 121*d*. However, without being limited thereto, the third feed pattern 123*c* and the fourth feed pattern 123*d* are not connected to the fourth antenna patch 160, they may be separated from the fourth antenna patch 160, and they may transmit the electric signal by a coupling.

The fourth antenna patch 160 may further include a first expansion or extension 161*a* and a second expansion or extension 161*b* which extend from two edges disposed near the third feed pattern 123*c* and the fourth feed pattern 123*d*. However, this is only an example, and the fourth antenna patch 160 may further include additional extensions or expansions which extend from two further edges of the fourth antenna patch 160.

The first expansion 161*a* and the second expansion 161*b* may have a rectangular and planar shape having a less length (l) than the seventh width Lx4 and the eighth width Ly4 of the fourth antenna patch 160.

The first expansion 161*a* and the second expansion 161*b* extend from two edges disposed near the third feed pattern 123*c* and the fourth feed pattern 123*d* from among the edges of the fourth antenna patch 160 and provide stepwise and planar shapes, so a length of a current path flowing along the edge of the fourth antenna patch 160 may increase.

The fourth antenna patch 160 includes a first opening 61*a* and a second opening 61*b* respectively disposed near the third feed pattern 123*c* and the fourth feed pattern 123*d*.

The first opening 61*a* and the second opening 61*b* of the fourth antenna patch 160 have semi-circular and planar shapes separated from the third feed pattern 123*c* and the fourth feed pattern 123*d* with a predetermined space therebetween and surrounding the third feed pattern 123*c* and the fourth feed pattern 123*d*.

When an electric signal is applied to the fourth antenna patch 160 through the third feed pattern 123*c* and the fourth feed pattern 123*d*, a first current may flow along a surface of the fourth antenna patch 160 in parallel to the first direction x from the third feed pattern 123*c*, and a second current may flow in parallel to the second direction y from the fourth feed pattern 123*d*.

The fourth antenna patch 160 may include a first opening 61*a* and second opening 61*b* separated from the third feed pattern 123*c* and the fourth feed pattern 123*d* with the predetermined space therebetween and disposed to surround the third feed pattern 123*c* and the fourth feed pattern 123*d*, so the first current flows along the edge of the first opening 61*a* from the third feed pattern 123*c* and then flows in parallel to the first direction x, and the second current flows along the edge of the second opening 61*b* from the fourth feed pattern 123*d* and flows then in parallel to the second direction y.

Therefore, the length of the current path flowing on the surface of the fourth antenna patch 160 may increase by the first opening 61*a* and the second opening 61*b* of the fourth antenna patch 160.

As described, the length of the current path flowing on the surface of the fourth antenna patch 160 may increase by the first expansion 161*a* and the second expansion 161*b* of the fourth antenna patch 160, the first opening 61*a*, and the second opening 61*b*, so a sufficient current path may be obtained while reducing the size of the fourth antenna patch 160, and intensity of a RF signal by the current may be increased. Accordingly, the gain of the antenna device 1000 may be increased.

According to the example, the first opening 61*a* and the second opening 61*b* of the fourth antenna patch 160 have semi-circular and planar shapes surrounding the third feed pattern 123*c* and the fourth feed pattern 123*d*, and without being limited thereto, the first opening 61*a* and the second opening 61*b* may have various types of planar shapes surrounding the third feed pattern 123*c* and the fourth feed pattern 123*d*.

The fourth antenna patch 160 may not overlap the sub-antenna patch 141 and the third antenna patch 151 configuring a coupling with the first antenna patch 130 to receive the electric signal from the first feed via 121*a* and the second feed via 121*b* in the third direction z.

Further, the third layer 220*c* and the fourth layer 220*d* of the second dielectric layer 220 are disposed between the third antenna patch 151 and the fourth antenna patch 160, thereby increasing isolation between the third antenna patch 151 and the fourth antenna patch 160.

Referring to FIG. 1 to FIG. 3 and FIG. 9, the fifth antenna patch 170 is disposed on the sixth layer 220*f* of the second dielectric layer 220.

In a non-limiting example, the fifth antenna patch 170 may have a quadrangular and planar shape.

The fifth antenna patch 170 may have a ninth width Lx5 in the first direction x, and may have a tenth width Ly5 in the second direction y. The ninth width Lx5 may be substantially equivalent to the tenth width Ly5.

The ninth width Lx5 and the tenth width Ly5 may be equivalent to the seventh width Lx4 and the eighth width Ly4.

The fifth antenna patch 170 may overlap the fourth antenna patch 160 in the third direction z, thereby configuring an additional coupling to the fourth antenna patch 160.

As described above, the first antenna patch 130 is connected to the first feed via 121*a* and the second feed via 121*b* so the first antenna patch 130 may receive electric signals from the first feed via 121*a* and the second feed via 121*b*.

The first antenna patch 130 and the center antenna patch 140 of the antenna device 1000 may transmit and receive first radio frequency (RF) signals in the first frequency bandwidth according to the electric signal applied through the first feed via 121*a* and the second feed via 121*b*. For example, the first frequency bandwidth may be about 24.25 GHz to about 29.5 GHz, and a center frequency of the first frequency bandwidth may be about 28 GHz.

In this example, the sub-antenna patch 141 may configure an additional coupling with the first antenna patch 130 and the center antenna patch 140, and the third antenna patch 151 may configure an additional coupling with the sub-antenna patch 141 and the center antenna patch 140, thereby forming additional impedance. Accordingly, the bandwidth of the signal transmitted and received by the antenna patches 130, 140, 141, and 151 may be increased without increasing the size of the first antenna patch 130.

The antenna device 1000 may transmit and receive a RF signal with first polarization through the electric signal applied by the first feed via 121*a*, and may transmit and receive a RF signal with second polarization through the electric signal applied by the second feed via 121*b*. In an example, the RF signal with first polarization may be a horizontal polarization signal, and the RF signal with second polarization may be a vertical polarization signal.

The fourth antenna patch 160 of the antenna device 1000 may transmit and receive the first RF signal in the second frequency bandwidth according to the electric signal applied through the third feed via 121*c* and the fourth feed via 121*d*. In an example, the second frequency bandwidth may be about 37 GHz to about 40 GHz, and the center frequency of the second frequency bandwidth may be about 38 GHz.

In this example, the fourth antenna patch 160 may overlap the fifth antenna patch 170 to configure an additional coupling and form additional impedance. Further, the fourth antenna patch 160 may include at least a first expansion 161*a* and a second expansion 161*b* that extend from at least two respective edges disposed near the third feed pattern 123*c* and the fourth feed pattern 123*d*, and has a first opening 61*a* and a second opening 61*b* disposed near the third feed pattern 123*c* and the fourth feed pattern 123*d*, so the path of the current flowing on the surface of the fourth antenna patch 160 may increase, and intensity of the RF signal by the current may be increased by acquiring a sufficient current path without increasing the size of the fourth antenna patch 160. Accordingly, the gain of the antenna device 1000 may be improved.

The antenna device 1000 may transmit and receive the RF signal with first polarization through the electric signal applied by the third feed via 121*c*, and may transmit and receive the RF signal with second polarization through the electric signal applied by the fourth feed via 121*d*. For example, the RF signal with first polarization may be a horizontal polarization signal, and the second polarization RF signal may be a vertical polarization signal.

The ground plane 201 may reflect the first RF signal and the second RF signal radiating toward the ground plane 201 from among the first RF signal and the second RF signal radiated by the antenna patches, so the radiation pattern of the antenna patches may be focused in the third direction z. Accordingly, the gain of the antenna device 1000 may be improved.

In an example, the antenna device 1000 is installed in the electronic device, a size of a bezel of the electronic device is reduced, and the antenna device 1000 is installed not in the front of the electronic device but on the lateral side of the bezel. As a form factor of the electronic device is reduced, the lateral side of the bezel in which the antenna device 1000 is installed becomes thin, and the width of the antenna device 1000 in the second direction y may be reduced.

The width of the antenna device 1000 in the second direction y is reduced, and the second width Ly1 in parallel to the second direction y may be less than the first width Lx1 in parallel to the first direction x of the ground plane 201. For example, the length of the first width Lx1 in parallel to the first direction x of the ground plane 201 may be about 5.25 mm, and the length of the second width Ly1 in parallel to the second direction y of the ground plane 201 may be about 4.2 mm. However, the length of the first width Lx1 of the ground plane 201 and the length of the second width Ly1 may not be limited thereto and may be variable.

The electric signal applied through the first feed via 121*a* may be propagated in a substantially parallel direction to the first direction x, and the electric signal applied through the second feed via 121*b* may be propagated in a substantially parallel direction to the second direction y.

Therefore, the first return current path of the ground plane 201 on the electric signal applied to the first feed via 121*a* may be substantially parallel to the first direction x, and the second return current path of the ground plane 201 on the electric signal applied to the second feed via 121*b* may be substantially parallel to the second direction y.

As described above, the second width Ly1 in parallel to the second direction y may be less than the first width Lx1 in parallel to the first direction x of the ground plane 201, so the second return current path of the ground plane 201 on the electric signal applied to the second feed via 121*b* may be shorter than the first return current path of the ground plane 201 on the electric signal applied to the first feed via 121*a*, a reflection coefficient characteristic of the second polarization RF signal in the first frequency bandwidth of the antenna device 1000 may be lowered, and the bandwidth of the second polarization RF signal of the antenna device 1000 may be lowered.

However, the antenna device 1000 includes a plurality of vias 110, and the vias 110 are connected to the ground plane 201. Accordingly, the vias 110 may provide an additional second return current path of the ground plane 201. As the antenna device 1000 includes a plurality of vias 110 as described above, the additional return current path is provided to the second polarization RF signal in the first frequency bandwidth having a relatively short return current path, and the bandwidth of the second polarization RF signal in the first frequency bandwidth of the antenna device 1000 may be prevented from being reduced.

Referring to FIG. 3, the antenna device 1000 may further include a third dielectric layer 230 disposed below the first dielectric layer 210 in the third direction z, and the third dielectric layer 230 may include a plurality of layers. The antenna device 1000 may further include a ground plane 201, feed layers 202 and 203, and a conductive layer 204 disposed between a plurality of layers of the third dielectric layer 230. The layers disposed below the first dielectric layer 210 of the antenna device 1000 are modifiable according to various examples.

Figure 10:
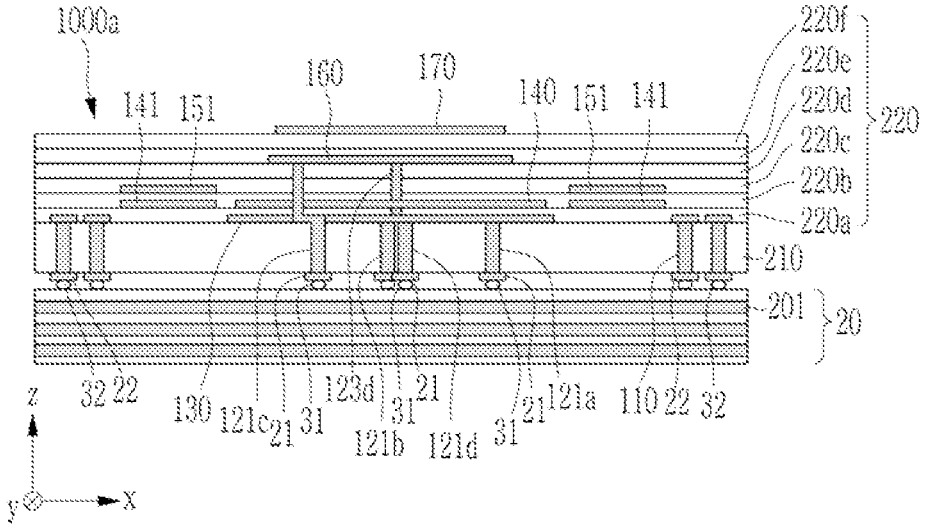
FIG. 10 illustrates a cross-sectional view of an antenna device, in accordance with one or more embodiments.

An antenna device 1000*a*, in accordance with one or more embodiments, will now be described with reference to FIG. 1, FIG. 2, FIG. 4 to FIG. 9, and FIG. 10. FIG. 10 illustrates a cross-sectional view of an example antenna device, in accordance with one or more embodiments.

The same constituent elements as the above-described antenna device 1000 according to an embodiment will be omitted.

Referring to FIG. 10, the antenna device 1000*a* may include a first feed via 121*a*, a second feed via 121*b*, a third feed via 121*c*, a fourth feed via 121*d*, a plurality of pads 21 and 22 disposed below the vias 110, and a plurality of connecting members 31 and 32 disposed below the pads 21 and 22. A plurality of connecting members 31 and 32 may be a solder ball, a pin, or a land.

The antenna device 1000*a* may further include a connection substrate 20 disposed below the first dielectric layer 210 in the third direction z and including a ground plane 201.

The first feed via 121*a*, the second feed via 121*b*, the third feed via 121*c*, the fourth feed via 121*d*, and a plurality of vias 110 may be electrically connected to the connection substrate 20 through a plurality of pads 21 and 22 and a plurality of connecting members 31 and 32.

The antenna device 1000*a* may be an independent configuration that is separated from the connecting member 20 including a ground plane 201, differing from the antenna device 1000 according to the above-described embodiment.

Many characteristics of the antenna device 1000, in accordance with one or more embodiments described with reference to FIG. 1 to FIG. 9 are applicable to the antenna device 1000*a* according to the present embodiment.

Figure 11:
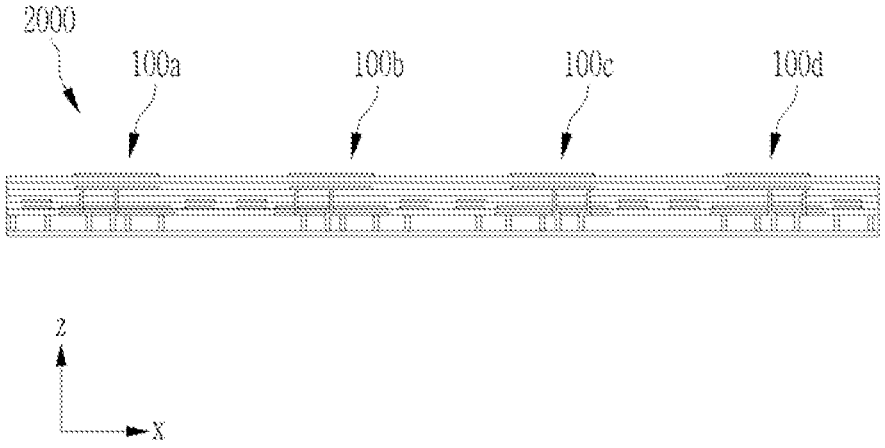
FIG. 11 illustrates a cross-sectional view of an antenna device, in accordance with one or more embodiments.
Figure 12:
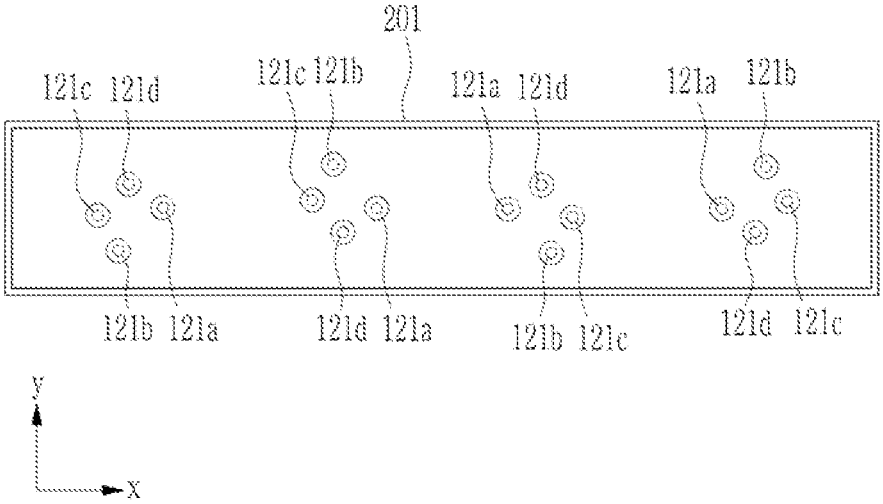
FIG. 12 illustrates a top plan view of part of an antenna device of FIG. 11.
Figure 13:
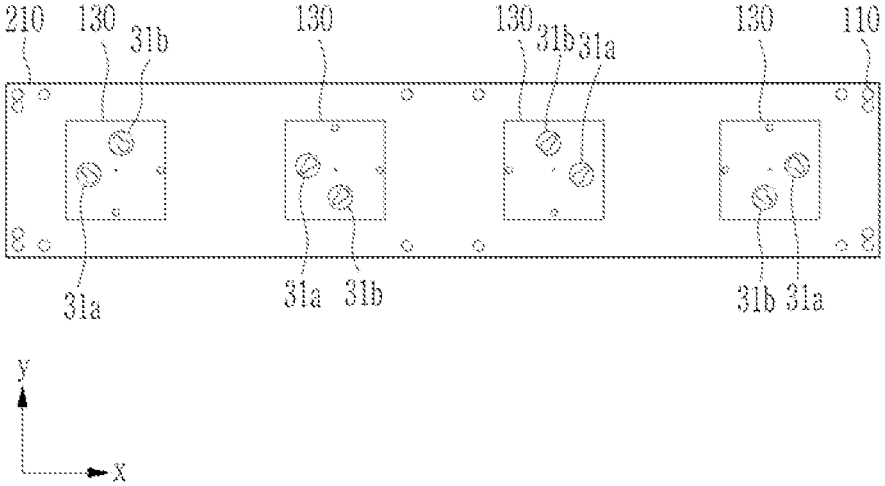
FIG. 13 illustrates a top plan view of part of an antenna device of FIG. 11.
Figure 14:
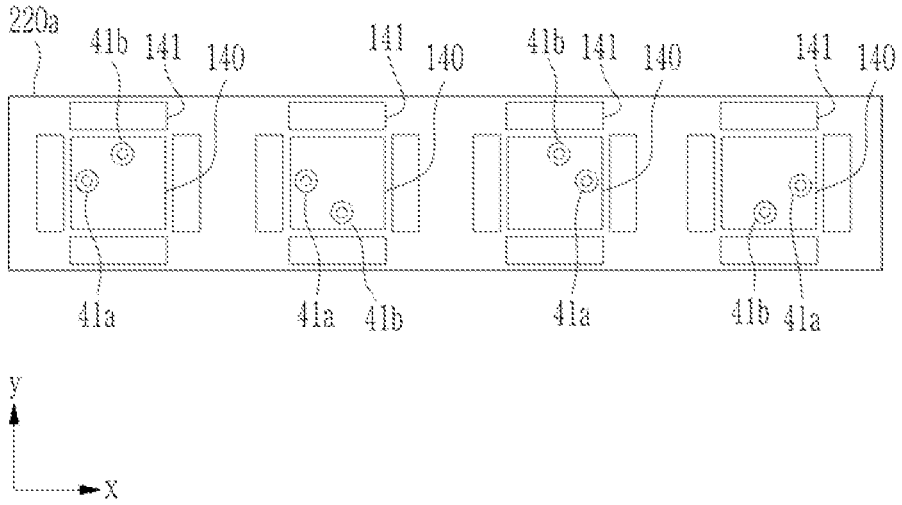
FIG. 14 illustrates a top plan view of part of an antenna device of FIG. 11.
Figure 15:
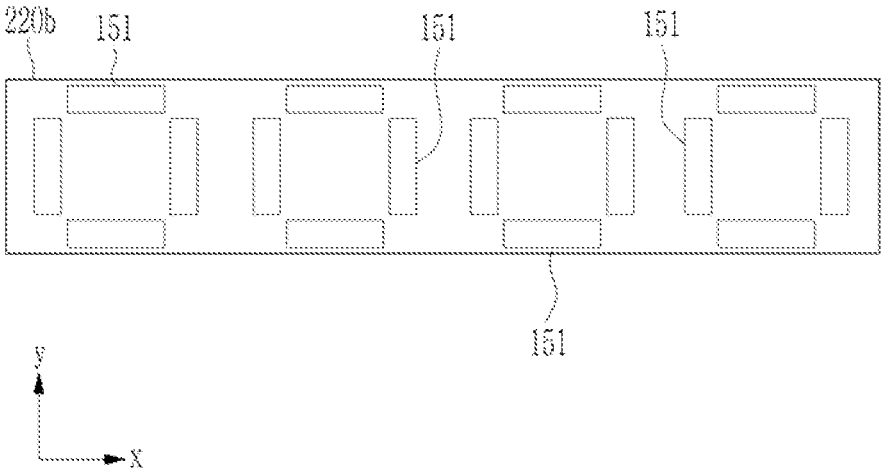
FIG. 15 illustrates a top plan view of part of an antenna device of FIG. 11.
Figure 16:
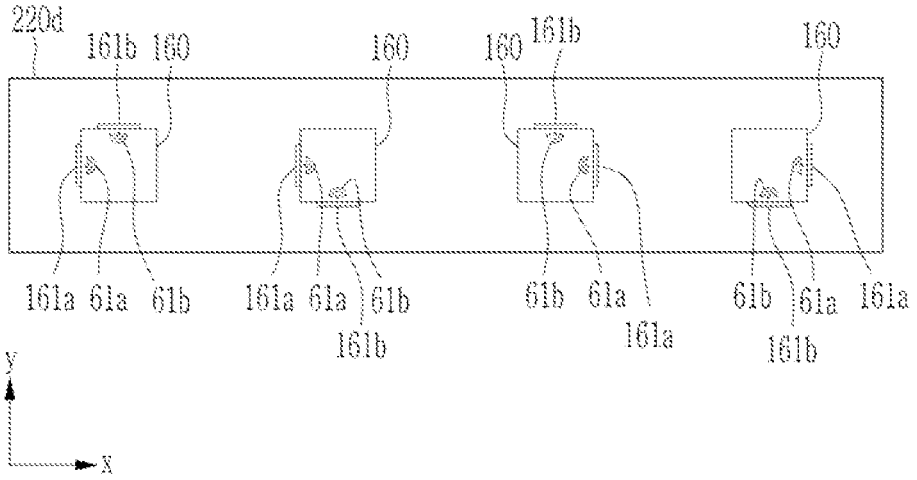
FIG. 16 illustrates a top plan view of part of an antenna device of FIG. 11.
Figure 17:
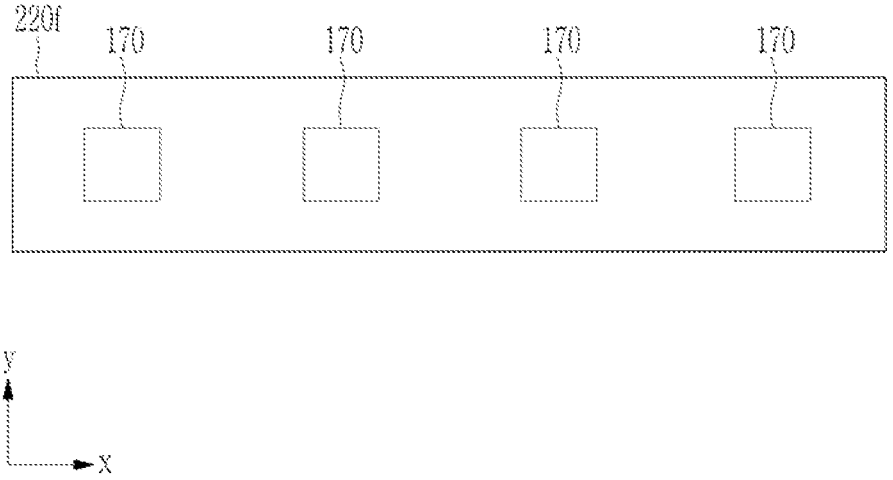
FIG. 17 illustrates a top plan view of part of an antenna device of FIG. 11.

An antenna device 2000, in accordance with one or more embodiments will now be described with reference to FIG. 11 and FIG. 12 to FIG. 17. FIG. 11 illustrates a cross-sectional view of an antenna device, in accordance with one or more embodiments, and FIG. 12 to FIG. 17 show top plan views of part of an antenna device of FIG. 11.

No detailed descriptions on the same constituent elements as the above-described antenna device 1000 according to an embodiment will be provided.

Referring to FIG. 11 and FIG. 12 to FIG. 17, the antenna device 2000 includes antennae 100*a*, 100*b*, 100*c*, and 100*d* that are similar to the above-described antenna device 1000 according to an embodiment described with reference to FIG. 1 to FIG. 9.

The antenna device 2000 includes a first antenna 100*a*, a second antenna 100*b*, a third antenna 100*c*, and a fourth antenna 100*d* sequentially disposed in the first direction x. Although only a first antenna 100*a*, a second antenna 100*b*, a third antenna 100*c*, and a fourth antenna 100*d* are illustrated, this is only an example, and less than four antennas and more than four antennas may be implemented.

The first antenna 100*a* of the antenna device 2000 may be disposed in a similar way to the above-described antenna device 1000 according to an embodiment, and the second antenna 100*b* of the antenna device 2000 may be symmetrical to the first antenna 100*a* with respect to a virtual line in parallel with the first direction x.

The third antenna 100*c* of the antenna device 2000 may be symmetrical to the first antenna 100*a* with respect to a virtual line in parallel to the second direction y, and the fourth antenna 100*d* of the antenna device 2000 may be symmetrical to the third antenna 100*c* with respect to a virtual line in parallel with the first direction x.

A disposal form of the first antenna 100*a*, the second antenna 100*b*, the third antenna 100*c*, and the fourth antenna 100*d* will now be described with reference to the disposal of the first feed via 121*a*, the second feed via 121*b*, the third feed via 121*c*, and the fourth feed via 121*d*.

Relative positions of the first feed via 121*a* and the third feed via 121*c* of the second antenna 100*b* may be equal to relative positions of the first feed via 121*a* and the third feed via 121*c* of the first antenna 100*a*, and relative positions of the second feed via 121*b* and the fourth feed via 121*d* of the second antenna 100*b* may be equal to a rotating position by 180 degrees at the positions of the second feed via 121*b* and the fourth feed via 121*d* of the first antenna 100*a*.

The relative positions of the first feed via 121*a* and the third feed via 121*c* of the third antenna 100*c* may be equal to the rotating position by 180 degrees at the positions of the first feed via 121*a* and the third feed via 121*c* of the first antenna 100*a*, and the relative positions of the second feed via 121*b* and the fourth feed via 121*d* of the third antenna 100*c* may be equal to the relative positions of the second feed via 121*b* and the fourth feed via 121*d* of the first antenna 100*a*.

The relative positions of the first feed via 121*a* and the third feed via 121*c* of the fourth antenna 100*d* may be equal to the rotating position by 180 degrees at the positions of the first feed via 121*a* and the third feed via 121*c* of the first antenna 100*a*, and the relative positions of the second feed via 121*b* and the fourth feed via 121*d* of the third antenna 100*c* may be equal to the rotating position by 180 degrees at the positions of the second feed via 121*b* and the fourth feed via 121*d* of the first antenna 100*a*.

As described, the antenna device 2000 may include a plurality of antennae 100*a*, 100*b*, 100*c*, and 100*d* disposed in different directions, thereby increasing directivity of the antenna device 2000, and transmitting and receiving the RF signal in various directions.

Many characteristics of the antenna device 1000 according to an embodiment described with reference to FIG. 1 to FIG. 9 are applicable to the antennae 100*a*, 100*b*, 100*c*, and 100*d* of the antenna device 2000.

Figure 18:
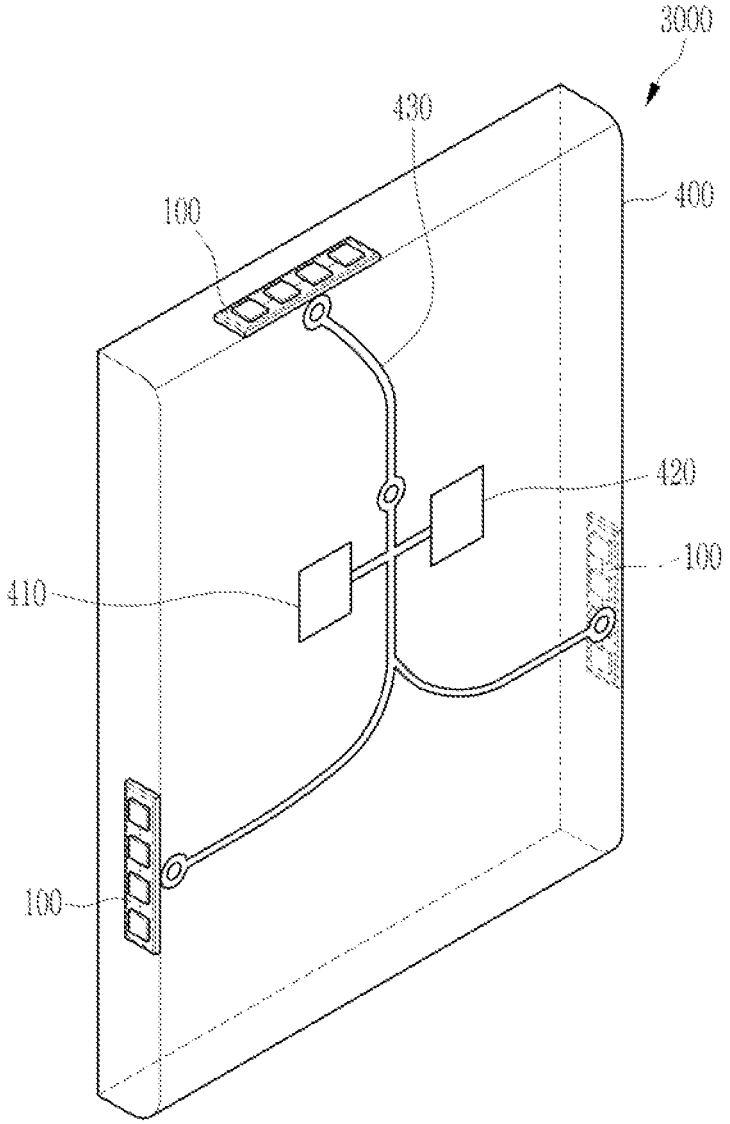
FIG. 18 illustrates a diagram of an example electronic device including an antenna device, in accordance with one or more embodiments.

An electronic device including an antenna device, in accordance with one or more embodiments, will now be described with reference to FIG. 18. FIG. 18 illustrates a diagram of an example electronic device including an antenna device, in accordance with one or more embodiments.

Referring to FIG. 18, the electronic device 3000 includes an antenna device 100, and the antenna device 100 is disposed to a set 400 of the electronic device 3000.

The electronic device 3000 may be, as non-limited examples, a smart phone, a personal digital assistant, a digital video camera, a digital still camera, a network system, a computer, a monitor, a tablet, a laptop, a netbook, a television, a video game, a smart watch, and an automotive device, and is not limited thereto.

The electronic device 2000, as illustrated in FIG. 11, may have a polygonal side, and the antenna device 1000, as illustrated in FIG. 1, may be disposed to be adjacent to at least part of a plurality of sides of the electronic device 2000.

A communication module 410 and a baseband circuit 420 may be disposed on the set 400, and the antenna device 1000 may be electrically connected to the communication module 410 and the baseband circuit 420 through a coaxial cable 430.

To perform digital signal processing, the communication module 410 may include at least one of memory chips such as a volatile memory (e.g., a DRAM), a non-volatile memory (e.g., a ROM), or a flash memory, application processor chips such as a central processing unit (e.g., CPU), a graphics processing unit (e.g., a GPU), a digital signal processor, an encoding processor, a microprocessor, or a microcontroller, and logic chips such as an analog-digital converter or an application-specific IC (ASIC).

The baseband circuit 420 may generate a base signal by performing analog to digital conversion, amplifying an analog signal, performing filtering, and performing frequency conversion. The base signal input/output from the baseband circuit 420 may be transmitted to the antenna device through a cable. In an example, the base signal may be transmitted to the IC through an electrical connection structure, a core via, and a wire, and the IC may convert the base signal to the RF signal in the millimeter wave (mm-Wave) bandwidth.

Although not shown, the antenna device 100 may be the above-described antenna device 2000.

Figure 19A:
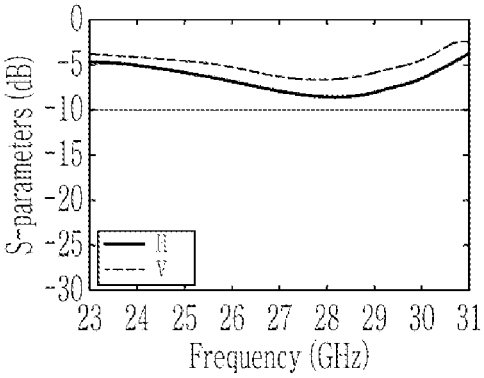
FIGS. 19A and 19B illustrate a graph of results according to an experimental example.
Figure 19B:
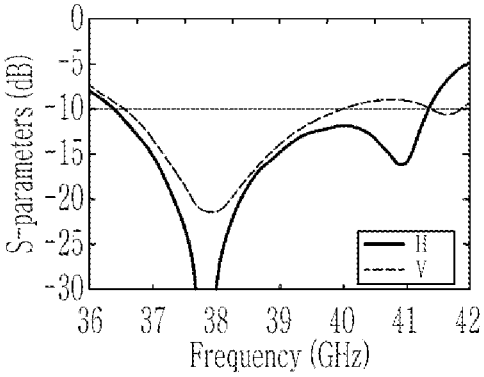

An experimental example will now be described with reference to FIGS. 19A and 19B. FIGS. 19A and 19B illustrate graph of results according to an experimental example.

In the present experimental example, when the first antenna patch 130 and the center antenna patch 140 are formed to transmit and receive the RF signal in the first frequency bandwidth, and the fourth antenna patch 160 and the fifth antenna patch 170 are formed to transmit and receive the RF signal in the second frequency bandwidth in a like manner of the typical antenna device, a reflection coefficient of the first frequency bandwidth and a reflection coefficient of the second frequency bandwidth are measured, and results are expressed as a graph in FIGS. 19A and 19B. FIG. 19A illustrates a result of a first frequency bandwidth, FIG. 19B illustrates a result of a second frequency bandwidth, and H is a result of horizontal polarization and V is a result of vertical polarization.

Referring to FIG. 19A and FIG. 19B, it is found that it may be difficult to acquire the reflection coefficient of −10 dB in the example of the first frequency bandwidth, and the reflection coefficient value of −10 dB is obtained in the relatively narrow frequency bandwidth in the case of vertical polarization in the case of the second frequency bandwidth.

As described, in a like manner of the typical antenna device, when two antenna patches overlapping each other in the third direction are used to transmit and receive the RF signals in the first frequency bandwidth and the second frequency bandwidth, it is found that the antenna characteristic is not good, and particularly, the antenna characteristic is worse in the first frequency bandwidth that is a low frequency bandwidth.

Figure 20A:
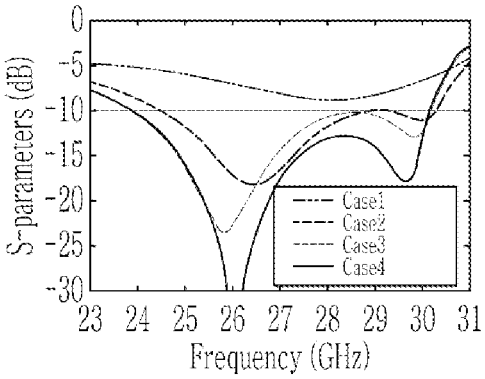
FIGS. 20A and 20B illustrate a graph of results according to an experimental example.
Figure 20B:
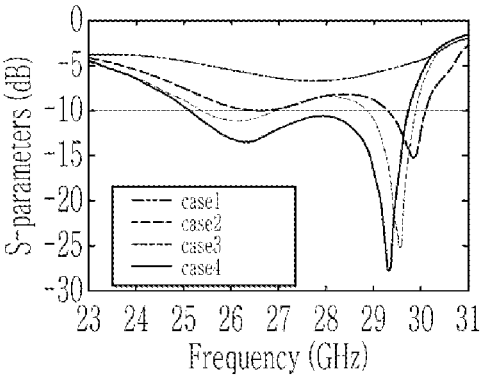

An experimental example will now be described with reference to FIGS. 20A and 20B. FIGS. 20A and 20B illustrate graphs of results according to an experimental example.

In the present experimental example, a first antenna patch 130 disposed on the first dielectric layer 210 and a center antenna patch 140 disposed on the first layer 220*a* of the second dielectric layer 220 are formed so as to transmit and receive the RF signal in the first frequency bandwidth.

Further, in the first case (case 1) in which the first antenna patch 130 and the center antenna patch 140 are formed and the sub-antenna patch 141 or the third antenna patch 151 is not formed, in the second case (case 2) in which the sub-antenna patch 141 disposed on the first dielectric layer 210 in a like manner of the first antenna patch 130 and disposed to surround the first antenna patch 130 is provided, in the third case (case 3) in which the sub-antenna patch 141 disposed on the first dielectric layer 210 and disposed to surround the first antenna patch 130 is provided, and the third antenna patch 151 is provided to be disposed on the first layer 220*a* of the second dielectric layer 220 and to overlap the sub-antenna patch 141 in the third direction z, and in the fourth case (case 4) in which the sub-antenna patch 141 is provided to be disposed on the first layer 220*a* of the second dielectric layer 220 and surround the center antenna patch 140 and the third antenna patch 151 is provided to be disposed on the second layer 220*b* of the second dielectric layer 220 and overlap the sub-antenna patch 141 in the third direction z in a like manner of the antenna devices according to embodiments, the reflection coefficient characteristics are measured, and corresponding results are shown in FIG. 20.

FIG. 20A illustrates a result of horizontal polarization in a first frequency bandwidth, and FIG. 20B illustrates a result of vertical polarization in the first frequency bandwidth.

Referring to FIGS. 20A and 20B, the frequency bandwidth may be expanded according to the cases (case 2, case 3, and case 4) in which the sub-antenna patch 141 or the third antenna patch 151 is formed in addition to the first antenna patch 130 and the center antenna patch 140 in comparison to the first case (case 1) in which the first antenna patch 130 and the center antenna patch 140 are formed and the sub-antenna patch 141 or the third antenna patch 151 is not formed.

Further, from among the cases (case 2, case 3, and case 4) in which the sub-antenna patch 141 or the third antenna patch 151 is formed in addition to the first antenna patch 130 and the center antenna patch 140, it is found that the reflection coefficient characteristic of the second case (case 4) in which the sub-antenna patch 141 is formed to be disposed on the first layer 220*a* of the second dielectric layer 220 and surround the center antenna patch 140 and the third antenna patch 151 is formed to be disposed on the second layer 220*b* of the second dielectric layer 220 and overlap the sub-antenna patch 141 in the third direction z is the best, in a like manner of the antenna devices according to embodiments.

Further, when FIG. 20A, which illustrates the horizontal polarization result is compared to FIG. 20B which illustrates the vertical polarization result, the reflection coefficient characteristic of vertical polarization is lower than the reflection coefficient characteristic of horizontal polarization. The reflection coefficient characteristic of vertical polarization is low in the low frequency region, particularly, around the bandwidth of 24 GHz.

This is because, as described above, the width of the antenna device 1000 in the second direction y is reduced, the second width Ly1 in parallel to the second direction y is less than the first width Lx1 of the ground plane 201 in the first direction x, and the second return current path of the plane 201 on the electrical signal for vertical polarization becomes shorter than the first return current path of the plane 201 on the electrical signal for horizontal polarization.

Figure 21A:
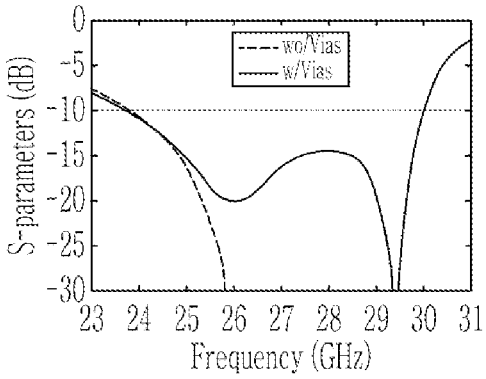
FIGS. 21A, 21B, and FIG. 22 illustrate a graph of results according to an experimental example.
Figure 21B:
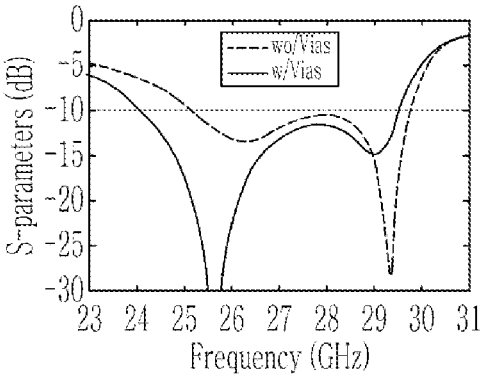
Figure 22:
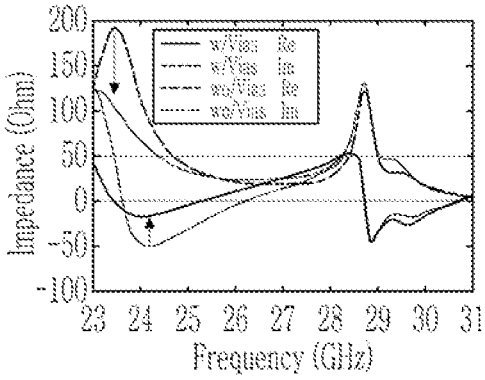

An experimental example will now be described with reference to FIGS. 21A and 21B, and FIG. 22. FIGS. 21A, 21B, and FIG. 22 illustrate graphs of results according to an experimental example.

In the present experimental example, the sub-antenna patch 141 is provided on the first layer 220*a* of the second dielectric layer 220 and to surround the center antenna patch 140, and the third antenna patch 151 is provided on the second layer 220*b* of the second dielectric layer 220 and to overlap the sub-antenna patch 141 in the third direction z. Further, the reflection coefficient characteristic of the first frequency bandwidth is measured for the case (wo/Vias) in which a plurality of vias 110 are not formed and the case (w/Vias) in which a plurality of vias 110 are formed in a like manner of the antenna devices according to embodiments, and results are shown in FIGS. 21A and 21B.

FIG. 21A illustrates a horizontal polarization result in a first frequency bandwidth and FIG. 21B illustrates a vertical polarization result in a first frequency bandwidth.

Further, impedance (Im) and resistance (Re) of vertical polarization in the first frequency bandwidth are measured for the case (wo/Vias) in which a plurality of vias 110 are not provided and the case (w/Vias) in which a plurality of vias 110 are provided in a like manner of the antenna devices according to embodiments, and the results are shown in the graph of FIG. 22.

Referring to FIG. 21, in the example of referring to the horizontal polarization result of the first frequency bandwidth, the reflection coefficient characteristic is not substantially changed when a plurality of vias 110 are formed, but in the example of referring to the vertical polarization result of the first frequency bandwidth, it is found that the reflection coefficient characteristic of the case (w/Vias) in which a plurality of vias 110 are formed is substantially improved compared to the case (wo/Vias) in which a plurality of vias 110 are not formed, and particularly, it is found that the reflection coefficient characteristic of vertical polarization is substantially improved in the low frequency region around the bandwidth of 24 GHz.

Referring to FIG. 22, compared to the case (wo/Vias) in which a plurality of vias 110 are not formed, it is found that the case of vertical polarization in the first frequency bandwidth improves the characteristic impedance of the case (w/Vias) in which a plurality of vias 110 are formed. Further, particularly in the low frequency region around the bandwidth of 24 GHz, compared to the example (wo/Vias) in which a plurality of vias 110 are not formed, in the example (w/Vias) in which a plurality of vias 110 are formed, it is found that input resistance is reduced and deviation of a resistance curve (Re) is reduced.

As described, in a like manner of the antenna devices according to embodiments, when a plurality of vias 110 are formed, it is found that impedance matching is maintained in the high frequency region (29.5 GHz), and relatively excellent impedance matching is shown in the low frequency region (24.25 GHz), so a broad-bandwidth characteristic is obtained.

An experimental example will now be described with reference to FIG. 23. FIG. 23 shows graphs of results of the experimental example.

In the present experimental example, a fourth antenna patch 160 and a fifth antenna patch 170 are formed to transmit and receive the RF signal in the second frequency bandwidth. In this instance, the reflection coefficient characteristic is measured, and regarding the case (case 1) in which the fourth antenna patch 160 does not have the first expansion 161*a*, the second expansion 161*b*, the first opening 61*a*, and the second opening 61*b*, the case (case 2) in which the fourth antenna patch 160 further includes the first expansion 161*a* and the second expansion 161*b* and does not include the first opening 61*a* and the second opening 61*b*, and the case (case 3) in which the fourth antenna patch 160 has the first expansion 161*a*, the second expansion 161*b*, the first opening 61*a*, and the second opening 61*b* in a like manner of the antenna devices according to embodiments, and the results are shown in FIGS. 23A and 23B.

Figure 23A:
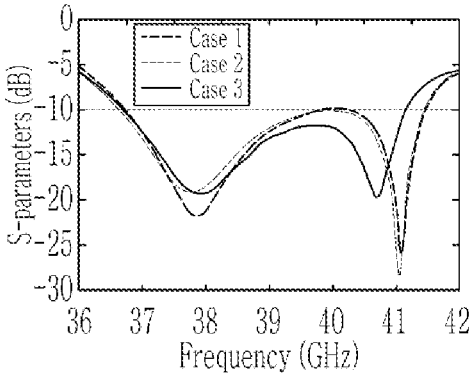
FIG. 23A and FIG. 23B illustrate a graph of results according to an experimental example.
Figure 23B:
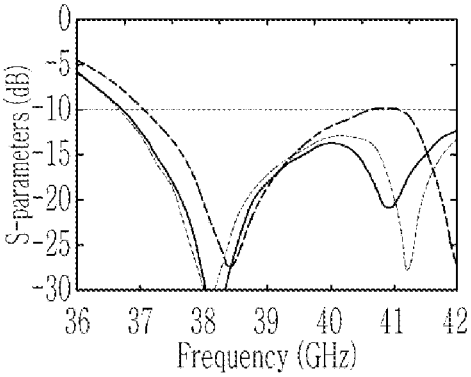

FIG. 23A illustrates a horizontal polarization result in a second frequency bandwidth, and FIG. 23B illustrates a vertical polarization result in a second frequency bandwidth.

Referring to FIGS. 23A and 23B, the reflection coefficient characteristics of the second case (case 2) and the third case (case 3) are improved compared to the first case (case 1). The reflection coefficient characteristic of the third case (case 3) is improved compared to the second case (case 2).

An experimental example will now be described with reference to Table 1. In the experimental example, the antenna device 1000 according to an embodiment described with reference to FIG. 1 to FIG. 9 is provided, frequency bandwidths and gains of the antenna device 1000 are measured, and results are expressed in Table 1.

TABLE 1

| Category | Polarization | Frequency bandwidth (GHz) | Antenna gain (dBi) |
|---|---|---|---|
| First frequency bandwidth | Horizontal polarization | 23.79 to 30.1 | 3.92 to 5.05 |
| | Vertical polarization | 24.16 to 29.62 | 3.79 to 5.33 |
| Second frequency bandwidth | Horizontal polarization | 36.64 to 41.13 | 3.93 to 4.38 |
| | Vertical polarization | 36.67 to 42.7 | 3.65 to 4.06 |

Referring to Table 1, the frequency bandwidth of horizontal polarization in the first frequency bandwidth measured with reference to the reflection coefficient of −10 dB is about 23.79 GHz to 30.1 GHz, and the frequency bandwidth of vertical polarization in the first frequency bandwidth is 24.16 GHz to 29.62 GHz, thereby satisfying an excellent frequency bandwidth and acquiring an excellent antenna gain. Further, the frequency bandwidth of horizontal polarization in the second frequency bandwidth measured with reference to the reflection coefficient of −10 dB is 36.64 GHz to 41.13 GHz, and the frequency bandwidth of vertical polarization in the second frequency bandwidth is 36.67 GHz to 42.7 GHz, thereby satisfying an excellent frequency bandwidth and acquiring an excellent antenna gain.

An experimental example will now be described with reference to Table 2. In the experimental example, the antenna device 2000 according to an embodiment described with reference to FIG. 11 is provided, the frequency bandwidths and the gains of the antenna device 2000 are measured, and results are expressed in Table 2.

TABLE 2

| Category | Polarization | Frequency bandwidth (GHz) | Antenna gain (dBi) |
|---|---|---|---|
| First frequency bandwidth | Horizontal polarization | 23.88 to 29.63 | 8.25 to 9.43 |
| | Vertical polarization | 24 to 29.52 | 8.74 to 9.80 |
| Second frequency bandwidth | Horizontal polarization | 36.75 to 40.88 | 10.36 to 11.19 |
| | Vertical polarization | 36.78 to 40.86 | 10.66 to 11.05 |

Referring to Table 2, the frequency bandwidth of horizontal polarization in the first frequency bandwidth measured with reference to the reflection coefficient of −10 dB is about 23.88 GHz to 29.63 GHz, and the frequency bandwidth of vertical polarization in the first frequency bandwidth is 24 GHz to 29.52 GHz, thereby satisfying an excellent frequency bandwidth and acquiring an excellent antenna gain. Further, the frequency bandwidth of horizontal polarization in the second frequency bandwidth measured with reference to the reflection coefficient of −10 dB is 36.75 GHz to 40.88 GHz, and the frequency bandwidth of vertical polarization in the second frequency bandwidth is 36.78 GHz to 40.86 GHz, thereby satisfying an excellent frequency bandwidth and acquiring an excellent antenna gain.

While this disclosure includes specific examples, it will be apparent after an understanding of the disclosure of this application that various changes in form and details may be made in these examples without departing from the spirit and scope of the claims and their equivalents. The examples described herein are to be considered in a descriptive sense only, and not for purposes of limitation. Descriptions of features or aspects in each example are to be considered as being applicable to similar features or aspects in other examples. Suitable results may be achieved if the described techniques are performed in a different order, and/or if components in a described system, architecture, device, or circuit are combined in a different manner, and/or replaced or supplemented by other components or their equivalents. Therefore, the scope of the disclosure is defined not by the detailed description, but by the claims and their equivalents, and all variations within the scope of the claims and their equivalents are to be construed as being included in the disclosure.

What is claimed is:

1. An antenna device, comprising:

a first antenna patch, configured to transmit and receive a radio frequency (RF) signal in a first frequency bandwidth, and disposed on a first dielectric layer of a plurality of dielectric layers;

a second antenna patch, disposed on a second dielectric layer of the plurality of dielectric layers, and coupled to the first antenna patch;

a third antenna patch, disposed on a third dielectric layer of the plurality of dielectric layers, and coupled to the second antenna patch; and a fourth antenna patch, disposed on a fourth dielectric layer of the plurality of dielectric layers, different from the third dielectric layer, and configured to transmit and receive an RF signal in a second frequency bandwidth, wherein the second antenna patch comprises a plurality of first sub-antenna patches that do not overlap the first antenna patch, and the third antenna patch comprises a plurality of second sub-antenna patches that overlap the first sub-antenna patches.

2. The antenna device of claim 1, wherein:

the second antenna patch further comprises a center antenna patch, and the first sub-antenna patches are separated from the center antenna patch, and are disposed to surround the center antenna patch in a first direction and a second direction, and wherein the center antenna patch overlaps the first antenna patch in a third direction that is perpendicular to the first direction and the second direction.

3. The antenna device of claim 2, wherein:

the fourth antenna patch does not overlap the third antenna patch in the third direction.

4. The antenna device of claim 3, further comprising:

a first feed via and a second feed via configured to penetrate at least one of the plurality of dielectric layers, wherein the first antenna patch is configured to receive electrical signals from the first feed via and the second feed via.

5. The antenna device of claim 4, further comprising:

a third feed via and a fourth feed via configured to penetrate at least one of the plurality of dielectric layers, wherein the fourth antenna patch is configured to receive electrical signals from the third feed via and the fourth feed via.

6. The antenna device of claim 5, wherein:

the fourth antenna patch further comprises a first expansion that extends from an edge disposed near the third feed via, and a second expansion that extends from an edge disposed near the fourth feed via.

7. The antenna device of claim 6, wherein:

the fourth antenna patch further comprises a first opening disposed near the third feed via, and a second opening disposed near the fourth feed via.

8. The antenna device of claim 5, wherein:

the first sub-antenna patches comprise a first sub-patch disposed near the first feed via, a second sub-patch disposed near the second feed via, a third sub-patch disposed near the third feed via, and a fourth sub-patch disposed near the fourth feed via, and wherein a first space between the center antenna patch and the first sub-patch is less than a second space between the center antenna patch and the third sub-patch.

9. The antenna device of claim 3, further comprising:

a ground plane, disposed below the plurality of dielectric layers in the third direction, wherein the ground plane has a first width in the first direction and a second width in the second direction, and wherein the first width is greater than the second width.

10. The antenna device of claim 9, further comprising:

a plurality of vias connected to the ground plane and configured to penetrate at least one of the plurality of dielectric layers, and wherein the vias do not overlap the first antenna patch and the second antenna patch in the third direction.

11. The antenna device of claim 10, wherein:

the first antenna patch has a third width in the first direction and a fourth width in the second direction, and wherein the fourth width is greater than the third width.

12. The antenna device of claim 11, wherein:

the center antenna patch has a fifth width in the first direction and a sixth width in the second direction, and wherein the fifth width is equal to the third width, and the sixth width is equal to the fourth width.

13. The antenna device of claim 12, wherein:

the fourth antenna patch has a seventh width in the first direction and an eighth width in the second direction, and wherein the seventh width is less than the fifth width, and the eighth width is less than the sixth width.

14. The antenna device of claim 13, further comprising:

a fifth antenna patch overlapping the fourth antenna patch in the third direction.

15. The antenna device of claim 14, wherein:

the fifth antenna patch has a ninth width in the first direction and a tenth width in the second direction, and the ninth width is equal to the seventh width, and the tenth width is equal to the eighth width.

16. An antenna device, comprising:

a plurality of antennae disposed in parallel with each other in a first direction, wherein the plurality of antennae comprise:

a first antenna patch, disposed on a first dielectric layer among a plurality of dielectric layers stacked in a third direction that is perpendicular to the first direction, and configured to transmit and receive a radio frequency (RF) signal in a first frequency bandwidth, a second antenna patch, disposed on a second dielectric layer among the plurality of dielectric layers, and coupled to the first antenna patch, a third antenna patch, disposed on a third dielectric layer among the plurality of dielectric layers, and coupled to the second antenna patch, a fourth antenna patch, disposed on a fourth dielectric layer among the plurality of dielectric layers, different from the third dielectric layer, and configured to transmit and receive an RF signal in a second frequency bandwidth, and a first feed via and a second feed via configured to penetrate at least one of the plurality of dielectric layers, and configured to apply an electrical signal to the first antenna patch, wherein the plurality of antennae include a first antenna and a second antenna, and respective positions of the second feed via, a third feed via, and a fourth feed via with respect to the first feed via of the first antenna are different from respective positions of the second feed via, the third feed via, and the fourth feed via with respect to the first feed via of the second antenna.

17. The antenna device of claim 16, wherein:

the second antenna patch comprises a center antenna patch that overlaps the first antenna patch in the third direction, and a plurality of first sub-antenna patches separated from the center antenna patch and configured to surround the center antenna patch.

18. The antenna device of claim 17, wherein:

the third antenna patch comprises a plurality of second sub-antenna patches overlapping the first sub-antenna patches in the third direction.

19. The antenna device of claim 18, wherein:

the fourth antenna patch does not overlap the third antenna patch in the third direction.

20. The antenna device of claim 18, wherein:

the plurality of antennae further includes a third antenna and a fourth antenna, wherein relative positions of the second feed via and the fourth feed via of the second antenna are equal to rotating positions by 180 degrees from the positions of the second feed via and the fourth feed via of the first antenna, wherein relative positions of the first feed via and the third feed via of the third antenna are equal to rotating positions by 180 degrees from the positions of the first feed via and the third feed via of the first antenna, and wherein relative positions of the first feed via, the second feed via, the third feed via, and the fourth feed via of the fourth antenna are equal to rotating positions by 180 degrees from the positions of the first feed via, the second feed via, the third feed via, and the fourth feed via of the first antenna.

* * * * *